US006035173A

United States Patent [19]

Kagawa

[11] Patent Number: 6,035,173

[45] Date of Patent: Mar. 7, 2000

[54] FIXING DEVICE HAVING A LEVELING BLADE COMPRISING A FLUORORESIN SHEET

[75] Inventor: Toshiaki Kagawa, Sakurai, Japan

[73] Assignee: Sharp Kabushiki Kaisha, Osaka, Japan

[21] Appl. No.: 09/007,165

[22] Filed: Jan. 14, 1998

[30] Foreign Application Priority Data

Jan. 23, 1997 [JP] Japan ..... 9-009885

[51] Int. Cl.[7] ..... G03G 15/20

[52] U.S. Cl. ..... 399/325; 118/60; 118/261; 156/327

[58] Field of Search ..... 399/324, 325; 118/60, 261, DIG. 2; 156/327, 329; 428/421, 422

[56] References Cited

U.S. PATENT DOCUMENTS 5,853,868 12/1998 Bracken et al. ..... 118/261 X

FOREIGN PATENT DOCUMENTS 60-60673 4/1985 Japan .
5-158371 6/1993 Japan .

*Primary Examiner*—William J. Royer
*Attorney, Agent, or Firm*—David G. Conlin; George W. Neuner; Dike, Bronstein, Roberts and Cushman LLP

[57] ABSTRACT

A fixing device is disclosed for fixing an unfixed toner image onto a sheet of paper by sandwiching in a contacting portion between an fixing roller and a pressing roller, and thus transporting, the sheet carrying thereon the unfixed toner image. The blade includes a base body made from a heat resistant rubber material (e.g., fluororubber) and a fluororesin sheet adhered to the surface of the base body by an adhesive agent so as to cover an edge portion of the blade. This permits provision of a fixing device with an oil-applying function which has superb durability and stability over a long period of time. The fluororesin sheet is preferably a tetrafluoroethylene=perfluoroalkylvinylether copolymer sheet. The adhesive agent is preferably a single component room-temperature-setting type silicone adhesive agent.

14 Claims, 4 Drawing Sheets

FIXING DEVICE HAVING A LEVELING BLADE COMPRISING A FLUORORESIN SHEET

FIELD OF THE INVENTION

The present invention relates to fixing devices used in electrophotographic apparatuses for implementing an electrophotographic process, such as copying machines, facsimiles, and printers, and particularly to fixing devices used in electrophotographic apparatuses that are capable of full color printing. More specifically, the present invention relates to fixing devices incorporating a blade for levelling mold releasing agent applied to a roller to prevent an offset phenomenon, and to a manufacturing of such blades.

BACKGROUND OF THE INVENTION

Conventionally, a heated roller fixing method has been typically adopted to a fixing device used in electrophotographic apparatuses such as copying machines and printers. According to the method, a recording material such as a recording sheet carrying an unfixed toner image is passed between a pair of heated and pressured rollers so that the toner image melts and is fixed onto the recording material.

However, a problem with the heated roller fixing method is that melted toner on the recording material is likely to induce sticking to the rollers (i.e., a so-called offset phenomenon). Especially, color electrophotographic apparatuses are susceptible to such a problem, since they use color toner, which is inferior to conventional black toner in the mold releasing property.

So, in order to prevent an offset phenomenon from occurring in fixing devices of present electrophotographic apparatuses, especially in those of color electrophotographic apparatuses, it is essential to apply an offset preventive agent (mold releasing agent) having low surface energy, such as silicone oil, to the surfaces of the rollers.

A conventional fixing device equipped with an oil applying device incorporates an oil applying felt, which typically works in the following manner: The oil in an oil tank is sucked up by a capillary phenomenon of the oil applying felt that is disposed to be, at the top end thereof, in contact with an oil applying roller and to be immersed, at the bottom end thereof, in the oil in the oil tank. The oil is thus applied onto the surface of the oil applying roller, and levelled to a predetermined thickness by an oil levelling blade that is pressed to the oil applying roller by a predetermined pressure. The oil on the oil applying roller is then transferred onto the surface of a fixing roller in a contacting portion between the oil applying roller and the fixing roller.

Since the oil levelling blade is required to resist heat and not to swell in silicone oil, the oil levelling blade is typically made of fluororubber. Nevertheless, an oil levelling blade made of fluororubber has drawbacks: (1) The fixing device needs a larger driving torque, (2) an enough amount of oil is not applied to prevent the offset phenomenon, since too large a part of the oil is scraped off by the edge portion of the blade, and (3) foreign bodies, such as felt fibers falling off the oil applying felt, paper powder, and offset toner, are likely to stick to the edge portion of the blade and disrupt levelled application of the oil.

Japanese Laid-Open Patent Applications No. 60- 60673/1985 (Tokukaisho 60-60673) and No. 5-158371/1993 (Tokukaihei 5-158371) and address these problems and disclose methods of: (1) coating the blade surface with a fluororesin layer; (2) adhering a "Teflon" (product name for the tetrafluoroethylene manufactured by E. I. du Pont de Nemours and Co.) sheet onto the blade surface; and (3) sticking "Teflon" tape onto the blade surface.

However, as per the method of coating the blade surface with a fluororesin layer, despite the heat resistance temperature of the fluororubber constituting the blade being 260° C., the fluororesin applied onto the blade surface needs to be baked at high temperatures, e.g. about 350° C. for polytetrafluoroethylene (PTFE) and about 320° C. for tetrafluoroethylene=perfluoroalkylvinylether copolymer (PFA). Such excess heat during baking degrades the fluororubber constituting the blade.

As per the method of adhering a "Teflon" sheet 80 onto the surface of a blade 56 constituted by a holder 56*a* and a blade segment 56*b* (see FIG. 5), the precision (evenness) of an edge portion A of the blade segment 56*b* declines and the oil is not uniformly applied, due to spillage of an adhesive agent 60 onto the edge portion A, non-uniform application of the adhesive agent 60 on the edge portion A, and/or other reasons. Such non-uniform application of oil leads to various undesirable results, including offset occurring where the oil is applied only in a less-than-required amount, and, if an image is printed on an OHP (overhead projector) sheet, a defective image with, for example, oily lines appearing on the OHP sheet.

As per the method of sticking "Teflon" tape onto the blade surface, the "Teflon" tape, which slides on the oil applying roller, wears thin and eventually cuts off in an edge portion due to insufficient durability thereof, and/or the "Teflon" tape, which sticks to the fluororubber only insufficiently, peels off the blade after a long use.

SUMMARY OF THE INVENTION

Objects of the present invention are to provide a fixing device with a mold-releasing-agent-applying function which has superb durability and stability over a long period of time, and to provide a manufacturing method of a blade incorporated in such a fixing device.

In order to accomplish the object, a fixing device in accordance with the present invention is a fixing device for fixing an unfixed developing agent image onto a recording material, and is characterized in that it includes: a fixing roller; a pressing roller, disposed to press the fixing roller, for sandwiching in a contacting portion between the pressing roller and the fixing roller, and thus transporting, the recording material carrying the unfixed developing agent image; a mold releasing agent applying section for applying a mold releasing agent onto at least either the surface of the fixing roller or the surface of the pressing roller; and a blade for levelling the mold releasing agent applied by the mold releasing agent applying section, wherein the blade includes: a base body made from a heat resistant rubber material and having an edge portion; and a fluororesin sheet adhered to the surface of the base body by an adhesive agent, wherein the fluororesin sheet is adhered onto at least two of circumferential planes of the base body forming the edge portion of the base body so as to cover the edge portion.

With the arrangement, since the fluororesin sheet is adhered onto at least the two planes forming the edge portion so as to cover the blade edge portion, the adhesive agent, even if it spills, does not stick to the edge portion, protecting the precision of the edge portion. This enables stable application of the mold releasing agent over a long period of time.

The fluororesin sheet is preferably formed of tetrafluoroethylene=perfluoroalkylvinylether copolymer (PFA). This improves the durability of the fluororesin sheet, and thereby prevents the fluororesin sheet from cutting off over a long period of time in use, adding to the lifetime of the device.

The fluororesin sheet preferably has a thickness from 25 μm to 100 μm. This prevents the fluororesin sheet from cutting off due to friction over a long period of time in use, improves the adhesion operability of the blade, and resolves problems such as improper capture of OHP sheets by the fixing device and reduced transparency of OHP sheets caused by application of too much oil.

The adhesive agent is preferably a single component room-temperature-setting type silicone adhesive agent. This gives the adhesive agent good fluidity and tack free time, and facilitates uniform application of the adhesive agent, therefore improving the adhesion operability of the fluororesin sheet. Also, since the adhesive agent has appropriate post-setting elasticity, the fluororesin sheet and the oil applying roller are unlikely to be scratched by the adhesive agent.

If a quick drying adhesive agent was used instead, the adhesive agent would quickly set, disrupting uniform application of the adhesive agent and resulting in poor operability in adhering the fluororesin sheet.

In order to accomplish the object, a method of manufacturing a blade in accordance with the present invention is characterized in that it includes the steps of:

(a) applying the adhesive agent on the surface of the base body;

(b) adhering the fluororesin sheet onto the base body with the adhesive agent; and (c) setting the adhesive agent by pressing the edge portion of the blade before the adhesive agent sets completely. The method eliminates non-uniform application of the adhesive agent in the edge portion when the adhesive agent is applied onto the blade, and thereby improves the precision of the edge portion of the blade.

In the step (c) of the method, the edge portion of the blade is preferably pressed under conditions (pressing force, pressing direction, and object to be pressed) specified based on the parallel conditions (pressing force, pressing direction, and object to be pressed) in real operation. To be more specific, in the step (c), the edge portion of the blade is preferably pressed under substantially the same conditions as those parallel conditions in real operation.

This enables the fluororesin sheet to be adhered onto the blade with the edge portion of the blade being maintained in substantially the same shape as in real operation, therefore being capable of fabricating the blade edge portion in an optimum shape. As a result, uniformity in oil application is further improved.

For a fuller understanding of the nature and advantages of the invention, reference should be made to the ensuing detailed description taken in conjunction with the accompanying drawings.

DESCRIPTION OF THE EMBODIMENTS

[FIRST EMBODIMENT]

Referring to FIGS. 1 through 4, the following description will discuss an embodiment in accordance with the present invention. In the present embodiment, the fixing device in accordance with the present invention is incorporated in a laser printer as an electrophotographic apparatus.

Figure 2:
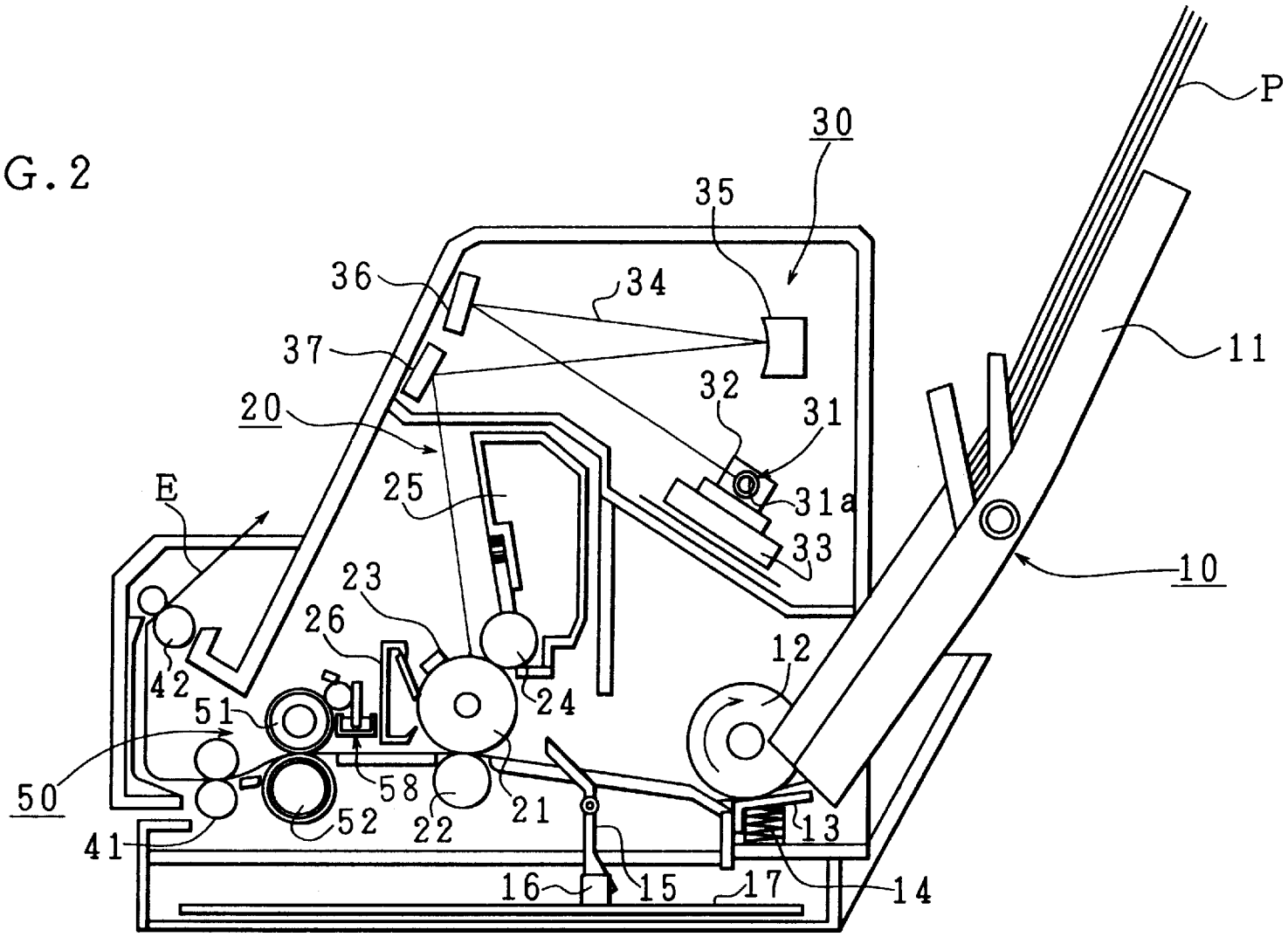
FIG. 2 is a schematic view showing the structure of a laser printer incorporating the fixing device of FIG. 1.

As shown in FIG. 2, the laser printer of the present embodiment includes a paper feeding section 10, an image forming device 20, a laser scanning section 30, and a fixing device 50.

The laser printer transports a sheet of paper P from the paper feeding section 10 to the image forming device 20. In the image forming device 20, a toner image is formed according to a laser beam 34 emitted by the laser scanning section 30, and transferred onto the transported sheet of paper P as a recording material. Next, in the image forming device 20, the sheet of paper P onto which the toner image is transferred is transported to the fixing device 50 where the toner image is fixed on the sheet of paper P. Finally, the sheet of paper P on which the toner image is fixed is ejected from the printer by paper transport rollers 41 and 42 disposed downstream from the fixing device 50 with respect to the paper transport direction. In other words, the sheet of paper P is transported along the path shown by the arrow-headed line E in FIG. 2 from a paper feeding tray 11 to the image forming device 20 and on to the fixing device 50, then ejected from the printer.

The paper feeding section 10 includes the paper feeding tray 11, a paper feeding roller 12, a paper separating friction board 13, a pressing spring 14, a paper detection actuator 15, a paper detecting sensor 16, and a control circuit 17. Upon receiving a print instruction, the paper feeding roller 12, the paper separating friction board 13, and the pressing spring 14 operate so as to feed sheets of paper P placed on the paper feeding tray 11 to the inside of the printer sheet by sheet. The sheet of paper P knocks down the paper detection actuator 15. In response to this, the paper detecting sensor 16 produces an electric signal to instruct the commencement of image printing. The control circuit 17, activated by the operation of the paper detection actuator 15, supplies image signals to a laser light-emitting diode unit 31 of the laser scanning section 30 to control turning-on and -off of the light emitting diode.

The laser scanning section 30 includes the laser light-emitting diode unit 31 for emitting the laser beam 34, a scanning mirror 32, a scanning mirror motor 33, and reflection mirrors 35, 36, and 37. The scanning mirror 32 is driven by the scanning mirror motor 33 to rotate at a high, constant speed. The laser beam 34 emitted by the laser light-emitting diode unit 31 is directed by the reflection mirrors 36, 35, and 37 onto a photosensitive body 21 (to be explained later). The laser beam 34 thus scans the surface of the photosensitive body 21 along the rotation axis thereof (in the directions perpendicular to the plane of the figure). The laser beam 34 is cast onto the photosensitive body 21 selectively according to the information on turning-on and -off supplied from the control circuit 17.

The image forming device 20 includes the photosensitive body 21, a transfer roller 22, a charging member 23, a developing roller 24, a developing unit 25, and a cleaning unit 26. The surface of the photosensitive body 21 which is charged in advance by the charging member 23 selectively discharges to form an electrostatic latent image on the photosensitive body 21. Toner used for development of the electrostatic latent image is stored in the developing unit 25. The toner, stirred properly in the developing unit 25 to be charged with electricity, sticks to the surface of the developing roller 24, and is supplied onto the photosensitive body 21 by an effect of the electric field generated by the surface potential of the photosensitive body 21 and the developing bias voltage applied across the developing roller 24. A toner image is thus formed on the photosensitive body 21 according to the electrostatic latent image.

The sheet of paper P transported from the paper feeding section 10 is sent forward as being sandwiched by the photosensitive body 21 and the transfer roller 22. The toner on the photosensitive body 21 is electrically attracted to the transfer roller 22 due to an effect of the electric field generated by the transfer voltage applied across the transfer roller 22. Consequently the toner image on the photosensitive body 21 is transferred onto the sheet of paper P by the transfer roller 22, and toner untransferred and remaining on the photosensitive body 21 is collected by the cleaning unit 26. Thereafter, the sheet of paper P is transported to the fixing device 50. In the fixing device 50, the sheet of paper P is pressed and heated properly by a pressing roller 52 and a fixing roller 51 which is kept at a temperature of 170° C. The toner thereby melts and is fixed on the sheet of paper P, forming a firmly fixed image. Thereafter, the sheet of paper P is transported by the paper transport rollers 41 and 42 to be ejected from the printer.

Figure 1:
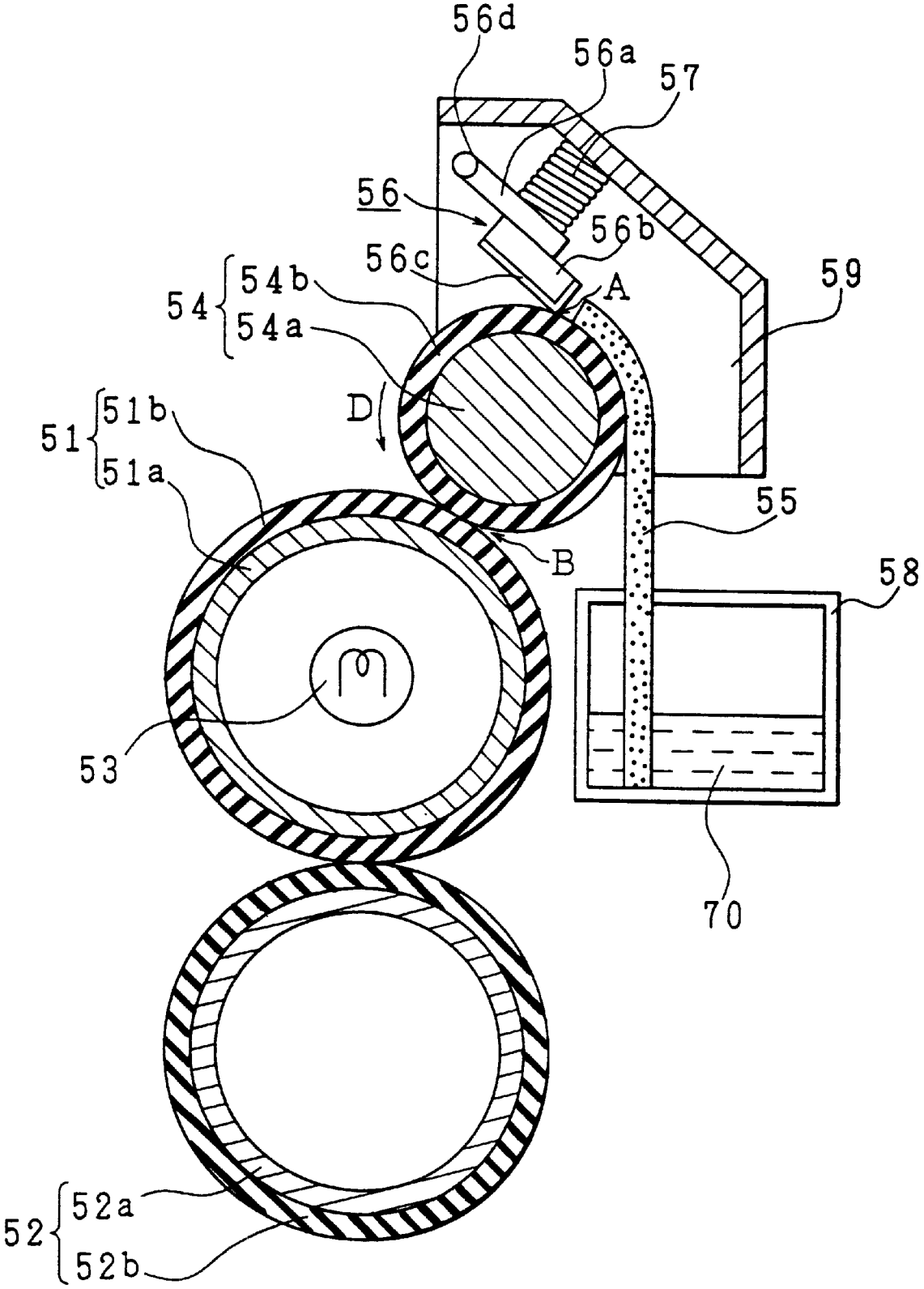
FIG. 1 is a schematic view showing the structure of a fixing device of an embodiment in accordance with the present invention.

With reference to FIG. 1, the fixing device 50 in accordance with the present invention will be explained.

As shown in FIG. 1, the fixing roller 51 is constituted by a hollow core 51*a,* made of aluminum, whose surface is coated with a mold releasing layer 51*b* of silicone rubber. Inside the fixing roller 51 is disposed a heater lamp 53 for heating the surface of the fixing roller 51 to a predetermined temperature.

The pressing roller 52 is constituted by a core 52*a,* made of stainless steel, whose surface is coated with an elastic layer 52*b* of silicone rubber. The pressing roller 52 is pressed to the fixing roller 51 by pressing means (not shown) with a predetermined pressure.

An oil applying device includes an oil applying roller 54, an oil applying felt 55, an oil levelling blade 56, a pressing spring 57, an oil tank 58, and a supporting frame 59. The oil tank 58 is filled with oil 70: specifically silicone oil with a kinematic viscosity of 300 cSt (KF-96 available from Shin-Etsu Chemical Co., Ltd.), as an example.

The oil applying roller 54 is constituted by a core 54*a,* made of stainless steel, whose surface is coated with a silicone rubber layer 54*b,* and is rotatably supported by the supporting frame 59. The oil applying roller 54 is pressed to the fixing roller 51 by pressing means (not shown) with a predetermined pressure, and driven by driving means (not shown) to rotate at the same peripheral speed as does the fixing roller 51.

The oil applying felt 55 is disposed to be, at the top end thereof, in contact with the oil applying roller 54 and to be immersed, at the bottom end thereof, in the oil 70 in the oil tank 58. The oil applying felt 55 is, for example, a "Nomex" (product name: available from E. I. du Pont de Nemours and Co.) with a METSUKE (mass per unit area) of 550 g/m$^2$ and a thickness of 2 mm.

The oil levelling blade 56 is supported by the supporting frame 59 rotatably around an axis 56*d,* and is pressed to the oil applying roller 54 by the pressing spring 57 with a predetermined pressure.

In the oil applying device configured in this manner, the oil 70 is sucked up from the oil tank 58 by a capillary phenomenon of the oil applying felt 55 and applied onto the surface of the oil applying roller 54. The oil 70 applied onto the oil applying roller 54 moves toward the oil levelling blade 56 with rotation of the oil applying roller 54 (as indicated by an arrow D in FIG. 1), is levelled to a predetermined thickness by the edge portion A of the oil levelling blade 56, and is transferred and applied onto the surface of the fixing roller 51 in a contacting portion B between the oil applying roller 54 with the fixing roller 51.

Next, with reference to FIG. 3, the construction of the oil levelling blade 56 will be explained in detail in the following.

Figure 3:
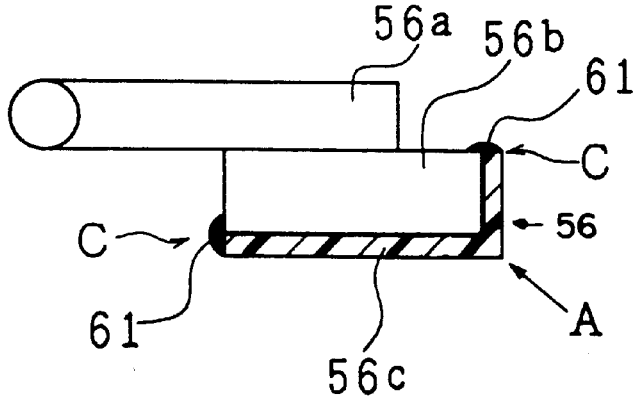
FIG. 3 is a schematic view showing the structure of an oil levelling blade of an embodiment in accordance with the present invention.

As shown in FIG. 3, in the oil levelling blade 56 of the present embodiment, the blade segment (base body) 56*b* is formed by integrally fabricating fluororubber with the holder 56*a* of stainless steel. A tetrafluoroethylene=perfluoroalkylvinylether copolymer resin sheet (hereinafter, PFA sheet) 56*c* of a 30$\mu$m thickness is adhered onto the two planes of the blade segment 56*b* forming the edge portion A by an adhesive agent 61 so as to cover the edge portion A. The adhesion surface of the PFA sheet 56*c* is made rough by treatment with a solving agent so as to improve the adhesion. A single component room-temperature-setting type silicone adhesive agent, "TSE 389" (product name: available from Toshiba Silicone Co., Ltd.) is used as the adhesive agent 61 for adhering the PFA sheet 56*c*.

As described above, the oil levelling blade 56 of the present embodiment is so configured that the PFA sheet 56*c* covers the edge portion A of the blade segment 56*b*. The uniformity of oil application, therefore, does not suffer from a possible spillage of the adhesive agent 61 outside the PFA sheet 56*c* in an adhering process. The adhesive agent 61, if it spills, only sticks to the far opposite side from the oil applying roller 54 (indicated as area C in FIG. 3), not sticking to the edge portion A.

Table 1 below shows results of experiment on how the amount of oil applied and the durability of the PFA sheet 56*c* change with the thickness of the PFA sheet 56*c*. Table 1 also shows results of experiment using "Teflon" tape disclosed in, for example, Japanese Laid-Open Patent Application No. 5-158371/1993 (Tokukaihei 5-158371) as a comparative example.

The experiment was conducted using an oil levelling blade 56 with PFA sheets 56*c* of the present embodiment adhered to the blade segment 56*b* by the adhesive agent 61 and a blade with "Teflon" tape (available from Nitto Denko Corporation, No. 903 UL, 80 $\mu$m thick) stuck to the blade segment 56*b*, the oil levelling blade 56 and the blade both being incorporated in the fixing device 50 shown in FIG. 1. Here, the weight of the oil adhered to an A4-sized OHP sheet, as a sheet of paper P, passed between the fixing roller 51 and the pressing roller 52 is referred to as the amount of oil applied. The durability was evaluated by visually observing the conditions of the edge portions of the PFA sheets 56*c* and the "Teflon" tape after running the fixing device 50 for a predetermined period of time. "Good" indicates that no abnormality was found, and "Not Good" indicates that an abnormality such as a cut was found.

TABLE 1

| | PFA Sheets | | | | | Teflon Tape |
|---|---|---|---|---|---|---|
| Thickness (μm) | 25 | 30 | 50 | 100 | 130 | 80 |
| Amount of Oil Applied (mg/A4) | 31 | 32 | 33 | 36 | 54 | 33 |
| Durability (Driving Time in hours) | Good (222h) | Good (222h) | Good (222h) | Good (222h) | Good (222h) | Not Good (24h) |

The results of the experiment demonstrate that the PFA sheets 56*c* were more durable than the "Teflon" tape, and even the PFA sheet 56*c* of a 25-μm thickness cleared the durability test lasting for 222 hours (comparable to the test in which about 150,000 pages of paper are successively fed at 12 PPM (pages per minute)) with no cut found in the edge portion. By contrast, the "Teflon" tape failed in the durability test lasting for 24 hours (comparable to the test in which about 17,000 pages of paper are successively fed at 12 PPM (pages per minute)) with the edge portion partially cut off. As a result, the amount of oil applied dropped drastically on the part of the surface of the OHP sheet corresponding to the cut.

It was also found in the 24-hour durability test that the "Teflon" tape, at an end thereof, had peeled off the blade segment 56*b*. This was presumably because the "Teflon" tape, which stuck to the fluororubber composing the blade segment 56*b*, peeled off the blade segment 56*b* after a long use due to heat and osmosis of silicone oil. By contrast, the PFA sheet 56*c*, which was adhered to the fluororubber composing the blade segment 56*b* by the adhesive agent 61, a silicone type adhesive agent with strong adhesion to fluororubber, did not peel off the blade segment 56*b* in the 222-hour durability test.

The PFA sheet 56*c* should be thicker for better durability. It is known, however, that the amount of oil applied increases with the thickness. This is because the radius of curvature of the blade edge portion A increases with the thickness and makes the edge portion A less effective in scraping the oil.

The results shown in Table 1 demonstrate that the amount of oil applied surged when the thickness of the PFA sheet 56*c* exceeded 100 μm. Problems were observed with the PFA sheet 56*c* of a 130-μm thickness due to application of too much oil: namely, improper capture and reduced transparency of the OHP sheet, as examples. Another problem with a thick PFA sheet 56*c* was poorer adhesion operability thereof onto the blade segment 56*b* due to a greater flexural rigidity of the PFA sheet 56*c*. Especially, when a silicone type adhesive agent with a long tack free time was used as the adhesive agent 61, the PFA sheet 56*c*, although having been adhered, peeled off before the adhesive agent 61 set. For these reasons, the thickness of the PFA sheet 56*c* is preferably in a range from 25 μm to 100 μm, and more preferably in a range from 30 μm to 50 μm.

Next, the adhesive agent 61 used in the present embodiment will be explained in detail in the following.

As described already, a single component room-temperature-setting type silicone adhesive agent is preferred as the adhesive agent 61 for adhering the PFA sheet 56*c* in the present embodiment for the following reasons:

1. The single component room-temperature-setting type silicone adhesive agent has enough fluidity, and tends to be uniformly applied. This prevents the precision of the edge portion A of the blade segment 56*b* from declining due to non-uniform application of the adhesive agent 61 to the edge portion A, and permits uniform application of oil.

2. The single component room-temperature-setting type silicone adhesive agent has an appropriate tack free time, facilitates adhesion operation, and makes it possible to remove wrinkles and bubbles formed when the PFA sheet 56*c* is adhered, resulting in a better yield.

3. The single component room-temperature-setting type silicone adhesive agent has appropriate elasticity even after it sets, being unlikely to scratch the PFA sheet 56*c* and the oil applying roller 54.

The inventors performed adhesion operation of the PFA sheet 56*c*, using adhesive agents 61 of various viscosities (fluidities), to examine adhesion operability, and found out that the adhesive agent 61 preferably had a pre-setting viscosity in a range from 10 P to 100 P at the temperature of 25° C. The adhesive agents 61 with a pre-setting viscosity less than 10 P at the temperature of 25° C. flowed down onto the holder 56*a* after being applied on the blade segment 56*b*. The adhesive agents 61 with a pre-setting viscosity more than 100 P at the temperature of 25° C. were difficult to apply uniformly, and made it difficult to adjust the PFA sheet 56*c* after it is adhered.

The inventors also performed adhesion operation of the PFA sheet 56*c*, using adhesive agents 61 of various tack free times, to examine adhesion operability, and found out that the adhesive agent 61 preferably had a tack free time in a range from 10 minutes to 60 minutes. The adhesive agents 61 with a tack free time shorter than 10 minutes set immediately after being applied, resulting in poor adhesion operability. The adhesive agents 61 with a tack free time longer than 60 minutes consumed too much time to set, resulting in poor adhesion operability.

The inventors also performed experiment on the post-setting hardness of the adhesive agent 61, using adhesive agents 61 of various hardnesses. In this experiment, the same durability test as the foregoing durability test was conducted with a PFA sheet 56*c* of a 30-μm thickness, and the adhesive agents 61 for the hardness is measured according to a method of measuring the hardness of vulcanized rubber with an A-type testing device based on JIS K 6301. Table 2 shows the results.

TABLE 2

| Hardness of Adhesive Agent (JIS K 6301) | 19° | 25° | 30° | 40° | 68° |
|---|---|---|---|---|---|
| Durability (Driving Time in hours) | Good (222h) | Good (222h) | Good (222h) | Good (222h) | Not Good (222h) |

After a 222-hour durability test with the adhesive agent 61 of the 68° post-setting hardness, an edge portion of the PFA sheet 56*c* was cut off, many scratches were found on the surface of the oil applying roller 54, and the oil was applied non-uniformly. An adhesive agent 61 having too high a post-setting hardness, as in this case, damages the PFA sheet 56*c* and the oil applying roller 54, causing non-uniform oil application. Therefore, the adhesive agent 61 preferably has a post-setting hardness of not more than 40°.

Figure 4:
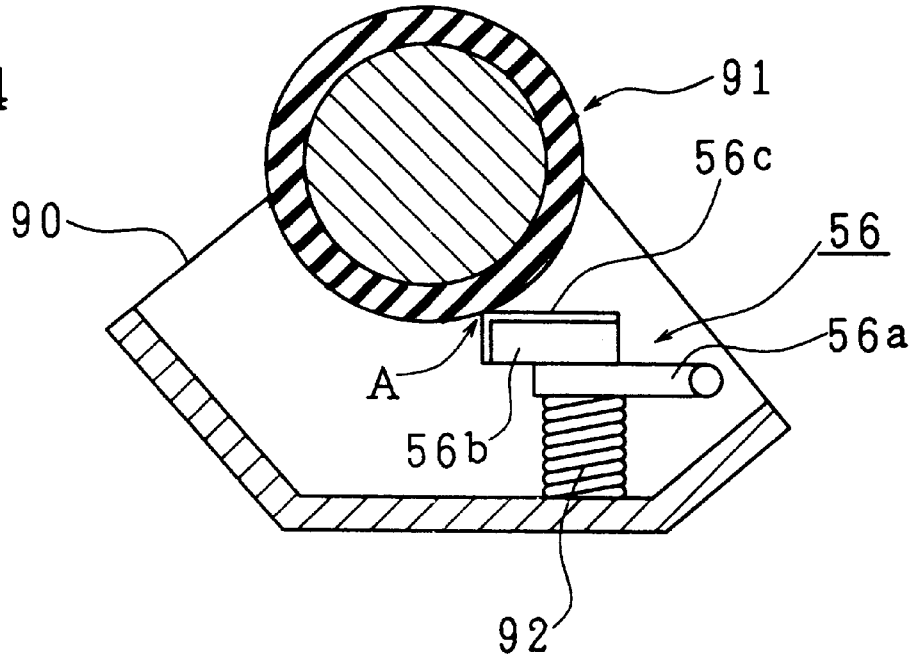
FIG. 4 is a drawing illustrating how to adhere a fluororesin sheet onto the oil levelling blade.
Figure 5:
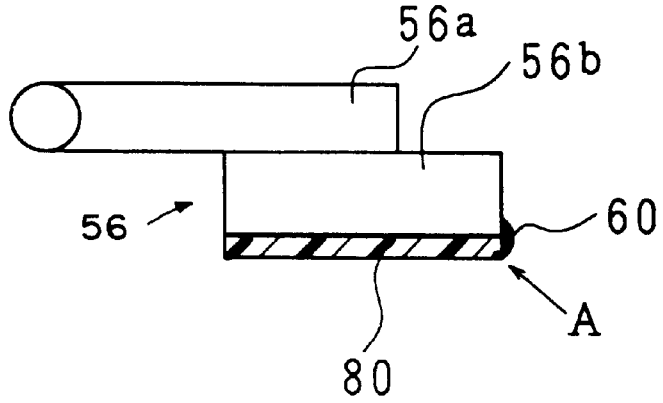
FIG. 5 PRIOR ART
FIG. 5 is a schematic view showing the structure of a conventional oil levelling blade.

With reference to FIG. 4, a preferable method of manufacturing the oil levelling blade 56, especially a preferable method of adhering the PFA sheet 56*c*, will be explained in the following.

An adhesive agent setting tool as a manufacturing device of the oil levelling blade 56 is constituted by a supporting frame 90, a pressing member 91, and a pressing spring 92 as shown in FIG. 4.

The oil levelling blade 56 is manufactured in the following process: The PFA sheet 56*c* is, first, adhered to the blade segment 56*b* with the adhesive agent 61 and then attached to the supporting frame 90 before the adhesive agent 61 completely sets. Next, the oil levelling blade 56 is pressed by the pressing spring 92 so that the edge portion A of the blade segment 56*b* is pressed by the pressing member 91. The adhesive agent 61 at this moment has not set completely, retaining fluidity. Therefore, the adhesive agent 61 on the edge portion A flows with pressure of the pressing member 91 and moves so as to spread uniformly on the surface of the pressing member 91. The adhesive agent 61 is left in this state to set. This eliminates non-uniform application, and further improves the precision of the edge portion A of the blade segment 56*b*.

For pressing the oil levelling blade 56, preferably, the oil applying roller 54, i.e. the pressing member in real operation, is used as the pressing member (pressing object) 91, and various conditions such as the pressing force on the oil levelling blade 56 and the contact angle (pressing direction) to the oil applying roller 54 are the same as those in real operation. This allows the edge portion A of the blade segment 56*b* to take an appropriate shape for real use after the adhesive agent 61 sets, further improving oil application uniformity.

Preferably the pressing force of the oil levelling blade 56 upon adhesion is within a range of ±20% of the pressing force of the oil levelling blade 56 in real operation. Therefore, in the present embodiment, since the pressing force of the oil levelling blade 56 in real operation is specified to 26.8N, the pressing force of the oil levelling blade 56 upon adhesion is preferably specified within a range of 21.4N to 32.2N.

Members other than the pressing member 91 of the adhesive agent setting tool shown in FIG. 4, such as the supporting frame 90 and the pressing spring 92, are also preferably the same as those used in real operation. This enables the fixing device 50 to be assembled, after the adhesive agent 61 sets, with the adhesive agent setting tool per se incorporated as a unit of the fixing device 50, leading to better mass productivity.

As described above, the fixing device 50 of the present embodiment includes a configuration such that the blade 56 constituted by the blade segment (base body) 56*b* made of heat resistant rubber and the PFA sheet (fluororesin sheet) 56*c* adhered onto the surface of the blade segment 56*b* with the adhesive agent 61, and that the PFA sheet 56*c* is adhered onto at least the two of circumferential planes of the blade segment 56*b* forming the edge portion A of the blade segment 56*b* so as to cover the edge portion A. This prevents the adhesive agent 61 from adhering to the edge portion A even when it spills, and protects the precision of the edge portion A.

As to the method of manufacturing the oil levelling blade 56, the PFA sheet 56*c* is adhered to the blade segment 56*b* after applying the adhesive agent 61 onto the surface of the blade segment 56*b*, and the edge portion A of the blade segment 56*b* is pressed before the adhesive agent 61 sets. Then the adhesive agent 61 is let to set in this state. This eliminates non-uniform application of the adhesive agent 61 in the edge portion A when the adhesive agent 61 is applied onto the blade segment 56*b*, and improves the precision of the edge portion A of the blade segment 56*b*.

[SECOND EMBODIMENT]

Figure 6:
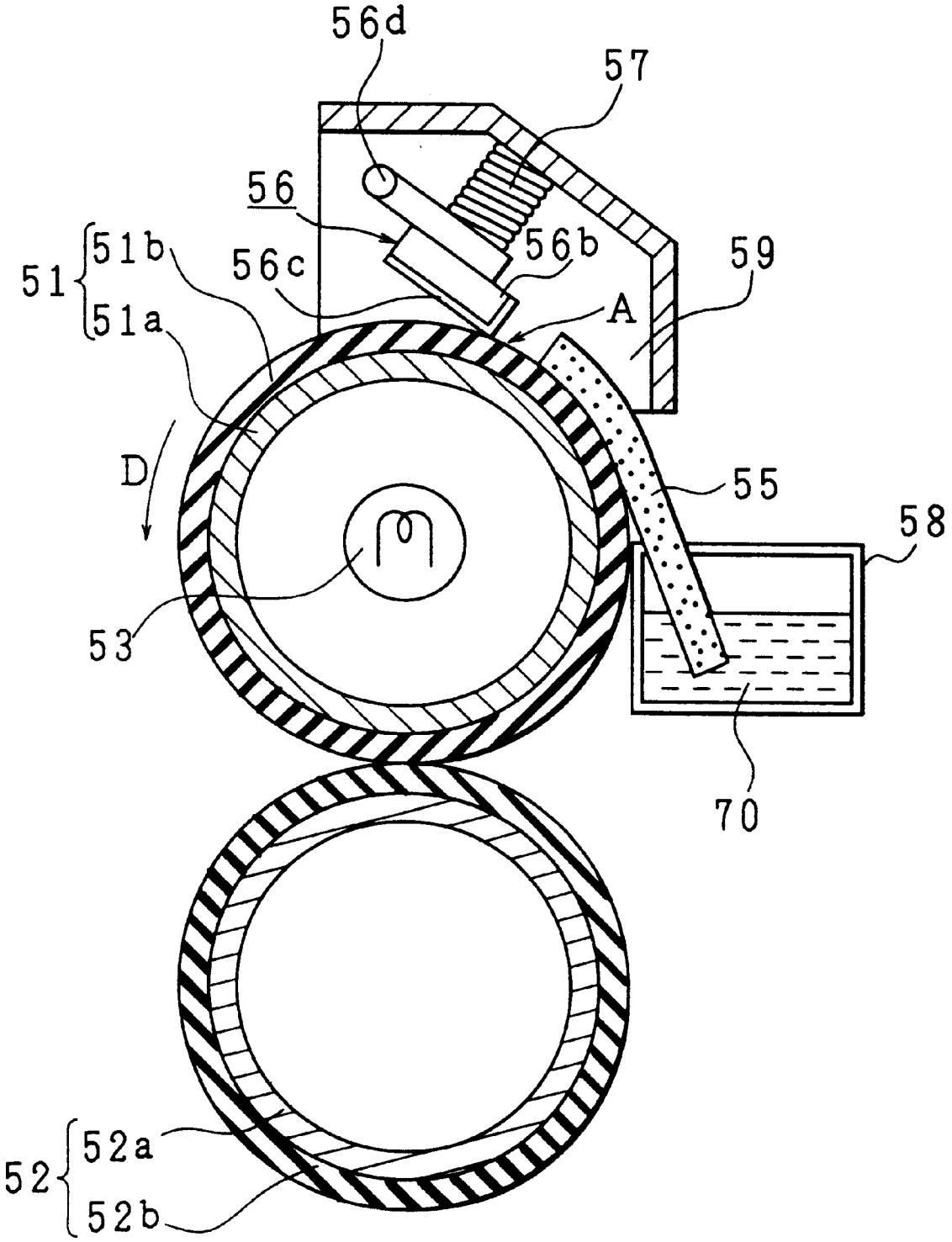
FIG. 6 is a schematic view showing the structure of a fixing device of a second embodiment in accordance with the present invention.

Referring to FIG. 6, the following description will discuss another embodiment in accordance with the present invention. Here, for convenience, members that have the same arrangement and function as those in the aforementioned figures are indicated by the same reference numerals and description thereof is omitted.

As shown in the schematic structure view of FIG. 6, a fixing device of the present embodiment is the fixing device of the first embodiment less the oil applying roller 54 in the oil applying device. Description is omitted of the configuration of the members other than the oil applying device of the fixing device, namely the fixing roller 51, the pressing roller 52, the heater lamp 53, etc., since they are totally the same as those in the first embodiment.

The oil applying device of the present embodiment includes an oil applying felt 55, an oil levelling blade 56, a pressing spring 57, an oil tank 58, and a supporting frame 59. Oil 70 is directly applied onto the surface of the fixing roller 51 by the oil applying felt 55.

The oil tank 58 is filled with the oil 70: specifically silicone oil with a kinematic viscosity of 300 cSt (KF-96 available from Shin-Etsu Chemical Co., Ltd.), as an example.

The oil applying felt 55 is disposed to be, at the top end thereof, in contact with the fixing roller 51 and to be immersed, at the bottom end thereof, in the oil 70 in the oil tank 58. The oil applying felt 55 is, for example, a "Nomex" (product name: available from E. I. du Pont de Nemours and Co.) with a METSUKE of 550 g/m$^2$ and a thickness of 2 mm.

The oil levelling blade 56 is supported by the supporting frame 59 rotatably around an axis 56*d*, and is pressed to the fixing roller 51 by the pressing spring 57 with a predetermined pressure.

In the oil applying device configured in this manner, the oil 70 is sucked up from the oil tank 58 by a capillary phenomenon of the oil applying felt 55 and applied onto the surface of the fixing roller 51. The oil 70 applied onto the fixing roller 51 moves toward the oil levelling blade 56 with rotation of the fixing roller 51 (as indicated by an arrow D in FIG. 6), and is levelled to a predetermined thickness by the edge portion A of the oil levelling blade 56.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A fixing device for fixing an unfixed developing agent image onto a recording material, comprising:

a fixing roller;

a pressing roller, disposed to press the fixing roller, for sandwiching in a contacting portion between the pressing roller and the fixing roller, and thus transporting, the recording material carrying the unfixed developing agent image;

mold releasing agent applying means for applying a mold releasing agent onto at least either the surface of the fixing roller or the surface of the pressing roller; and a blade for levelling the mold releasing agent applied by the mold releasing agent applying means, wherein the blade includes:

a base body made from a heat resistant rubber material and having an edge portion; and a fluororesin sheet adhered to the surface of the base body by an adhesive agent, wherein the fluororesin sheet is adhered onto at least two of circumferential planes of the base body forming the edge portion of the base body so as to cover the edge portion.

2. The fixing device as defined in claim 1, wherein the mold releasing agent applying means applies the mold releasing agent onto at least either the surface of the fixing roller or the surface of the pressing roller with an applying roller, and the blade levels the mold releasing agent on the applying roller.

3. The fixing device as defined in claim 1, wherein the mold releasing agent applying means applies the mold releasing agent onto at least either the surface of the fixing roller or the surface of the pressing roller in a direct manner.

4. The fixing device as defined in claim 1, wherein the fluororesin sheet is formed of tetrafluoroethylene=perfluoroalkylvinylether copolymer.

5. The fixing device as defined in claim 1, wherein the fluororesin sheet has a thickness ranging from 25 μm to 100 μm.

6. The fixing device as defined in claim 1, wherein the fluororesin sheet has a thickness ranging from 30 μm to 50 μm.

7. The fixing device as defined in claim 4, wherein the fluororesin sheet has a thickness ranging from 25 μm to 100 μm.

8. The fixing device as defined in claim 1, wherein the adhesive agent is a silicone adhesive agent.

9. The fixing device as defined in claim 1, wherein the adhesive agent is a single component room-temperature-setting type silicone adhesive agent.

10. The fixing device as defined in claim 4, wherein the adhesive agent is a single component room-temperature-setting type silicone adhesive agent.

11. The fixing device as defined in claim 1, wherein the adhesive agent has a post-setting hardness not more than 40°.

12. The fixing device as defined in claim 1, wherein the heat resistant rubber material is fluororubber.

13. The fixing device as defined in claim 1, wherein the mold releasing agent is silicone oil.

14. The fixing device as defined in claim 1, further comprising heating means for heating the fixing roller.

* * * * *